US012767285B2

(12) United States Patent
Rietema

(10) Patent No.: US 12,767,285 B2
(45) Date of Patent: Oct. 20, 2026

(54) FLOATING HAMMOCK AND CARRYING BAG APPARATUS

(71) Applicant: Justin Rietema, Fort Lauderdale, FL (US)

(72) Inventor: Justin Rietema, Fort Lauderdale, FL (US)

( * ) Notice: Subject to any disclaimer, the term of this patent is extended or adjusted under 35 U.S.C. 154(b) by 310 days.

(21) Appl. No.: 18/631,939

(22) Filed: Apr. 10, 2024

(65) Prior Publication Data

US 2024/0336335 A1 Oct. 10, 2024

Related U.S. Application Data

(60) Provisional application No. 63/495,253, filed on Apr. 10, 2023.

(51) Int. Cl.
*B63B 34/52* (2020.01)

(52) U.S. Cl.
CPC ..... *B63B 34/52* (2020.02)

(58) Field of Classification Search
CPC ..... B63B 34/52
See application file for complete search history.

(56) References Cited

U.S. PATENT DOCUMENTS

| | | | | |
|---|---|---|---|---|
| 6,931,678 | B2 * | 8/2005 | Boyd | B63B 34/52 5/120 |
| 9,221,527 | B1 * | 12/2015 | Zeyger | A47C 15/006 |
| 2016/0016643 | A1 * | 1/2016 | Santaw | B63B 34/50 441/129 |
| 2023/0189952 | A1 * | 6/2023 | Dogagis | A45F 4/06 224/577 |

* cited by examiner

*Primary Examiner* — Evan P Dzierzynski

(57) ABSTRACT

A floating hammock and carrying bag apparatus includes a main body, an outer edge, a left fastener, and a right fastener. The main body includes a buoyant head portion, a first middle portion, a second middle portion, and a buoyant foot portion. The buoyant head portion is adjacently connected to the first middle portion. The second middle portion is adjacently and foldably connected to the first middle portion, opposite of the buoyant head portion. The buoyant foot portion is adjacently connected to the second middle portion, opposite of the first middle portion. The outer edge is perimetrically connected around the main body. The left fastener is connected along a left edge of the outer edge. The right fastener is connected along a right edge of the outer edge. The main body being configured between a hammock configuration and a bag configuration through the left fastener and the right fastener.

18 Claims, 6 Drawing Sheets

FLOATING HAMMOCK AND CARRYING BAG APPARATUS

The current application claims a priority to the U.S. Provisional Patent application Ser. No. 63/495,253 filed on Apr. 10, 2023.

FIELD OF THE INVENTION

The present invention generally relates to a leisure pool apparatus. More specifically, the present invention functions as a floating hammock for floating leisurely in one embodiment and a carrying bag in another embodiment.

BACKGROUND OF THE INVENTION

Hammocks are well known devices used for resting while being suspended. However, hammocks need to be suspended from supports that are able to withstand the weight of the user or users. The supports are usually large well-set posts with strong straps attached to either end of the hammock for suspension. Leisure pool toys and apparatuses are well known apparatuses for floating are also known. Large inflatables for resting in pools and other bodies of water allow users to float above the water. These inflatables are typically made of a plastic membrane that are quite uncomfortable to relax and often the surface retains heat and becomes hot from the radiation from the sun. The existing inflatables are often prone to punctures and fail to hold air. The existing inflatables are also rather unwieldy, hard to carry, and quite cumbersome.

An objective of the present invention is to provide a floating hammock to be used on a body of water for resting. The present invention improves upon other prior art by suspending the person within the water while holding the head above the water line. This reduces the amount of surface exposed to the direct sunlight that typically heats the exposed surfaces and becomes hot to the touch. A further objective of the present invention is to provide a floating hammock that reduces or eliminates the air-filled sections by incorporating a middle portion that does not require air to suspend the person. A further objective of the present invention is to function as a carrying bag so that the user can easily store and carry necessary items such as sunscreens, sunglasses, personal electronic devices, food items, beverage items, and other beach or pool related essentials.

SUMMARY OF THE INVENTION

The present invention comprises a head portion, a middle portion, and a foot portion as the head portion and foot portion function as the inflatable chambers. A first configuration of the present invention, the head portion and the foot portion are cylindrical bodies when filled with a fluid such as air. The head portion and foot portion are connected together by the middle portion. The middle portion is configured into a rectangular shape and terminally connected to the foot portion and head portion to support the weight of the user. A second configuration of the present invention allows the user to fold the present invention into a convenient carrying bag.

DETAILED DESCRIPTION OF THE INVENTION

Figure 1:
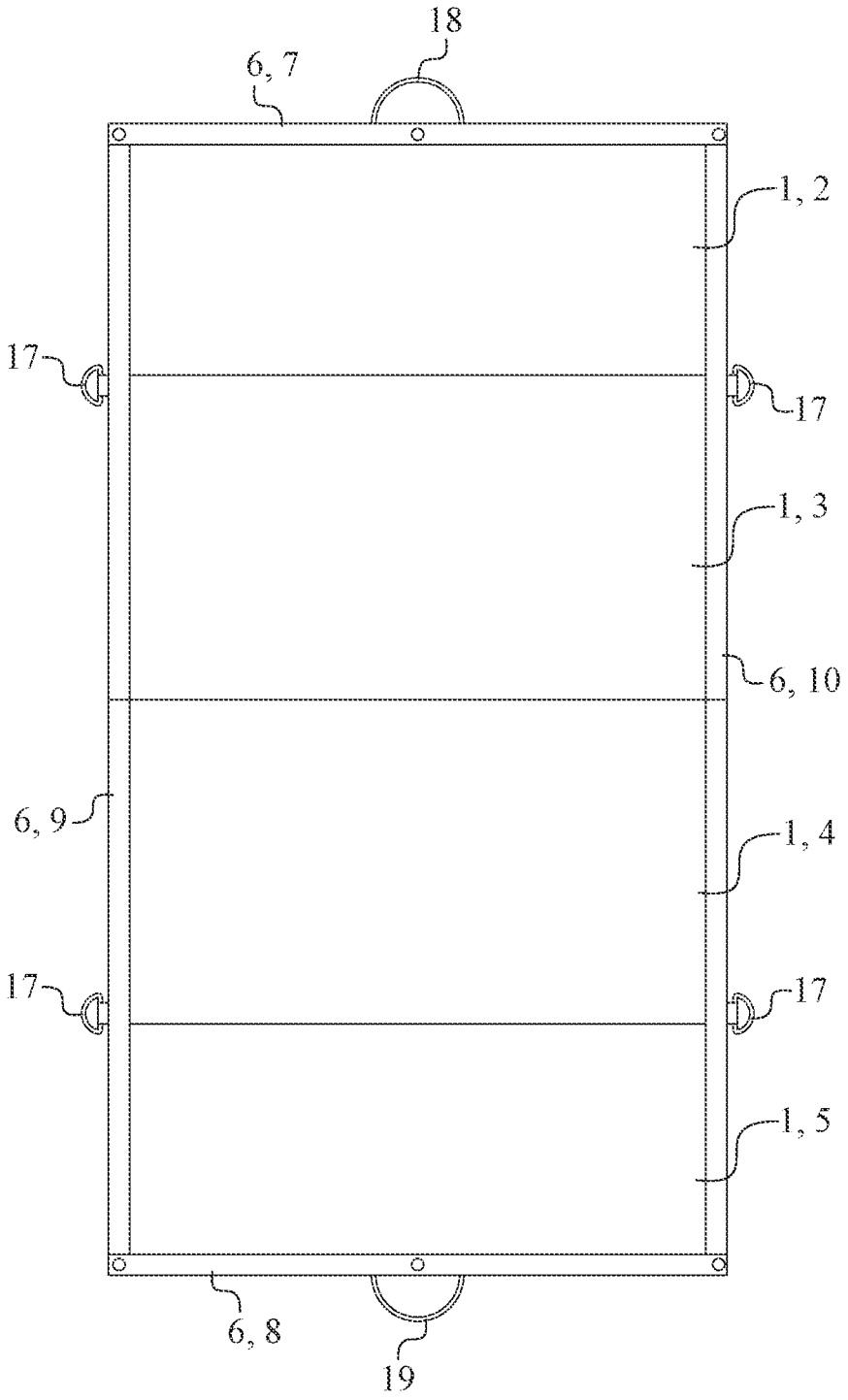
FIG. 1 is a rear view of the present invention in the hammock configuration.

All illustrations of the drawings are for the purpose of describing selected versions of the present invention and are not intended to limit the scope of the present invention.

The present invention is a floating hammock and carrying bag apparatus. More specifically, the present invention can be configured into a hammock configuration to be used on a body of water for resting. The present invention can also be configured into a bag configuration to store and carry essential items such as sunscreens, sunglasses, personal electronic devices, food items, beverage items, and other beach or pool related items.

In reference to general configuration, the present invention comprises a main body 1, an outer edge 6, a left fastener 11, and a right fastener 12 as shown in FIGS. 1-6. The main body 1 functions as the main surface area of the hammock configuration and the bag configuration comprises a buoyant head portion 2, a first middle portion 3, a second middle portion 4, and a buoyant foot portion 5. The buoyant head portion 2 is adjacently connected to the first middle portion 3. The second middle portion 4 is adjacently and foldably connected to the first middle portion 3, opposite of the buoyant head portion 2. The buoyant foot portion 5 is adjacently connected to the second middle portion 4 and positioned opposite of the first middle portion 3. As a result, the buoyant head portion 2, the first middle portion 3, the second middle portion 4, and the buoyant foot portion 5 are formed into a rectangular body thus delineating the general shape of the main body 1. The outer edge 6 is perimetrically connected around the buoyant head portion 2, the first middle portion 3, the second middle portion 4, and the buoyant foot portion 5 so that the remaining components of the present invention can be connected to the main body 1. The left fastener 11 that completes the left end of the bag configuration is connected along a left edge 9 of the outer edge 6. The right fastener 12 that completes the right end of the bag configuration is connected along a right edge 10 of the outer edge 6. In other words, the left fastener 11 and the right fastener 12 are oppositely positioned of each other about the main body 1 thus allowing the main body 1 to be configured between the hammock configuration and the bag configuration through the left fastener 11 and the right fastener 12.

Figure 2:
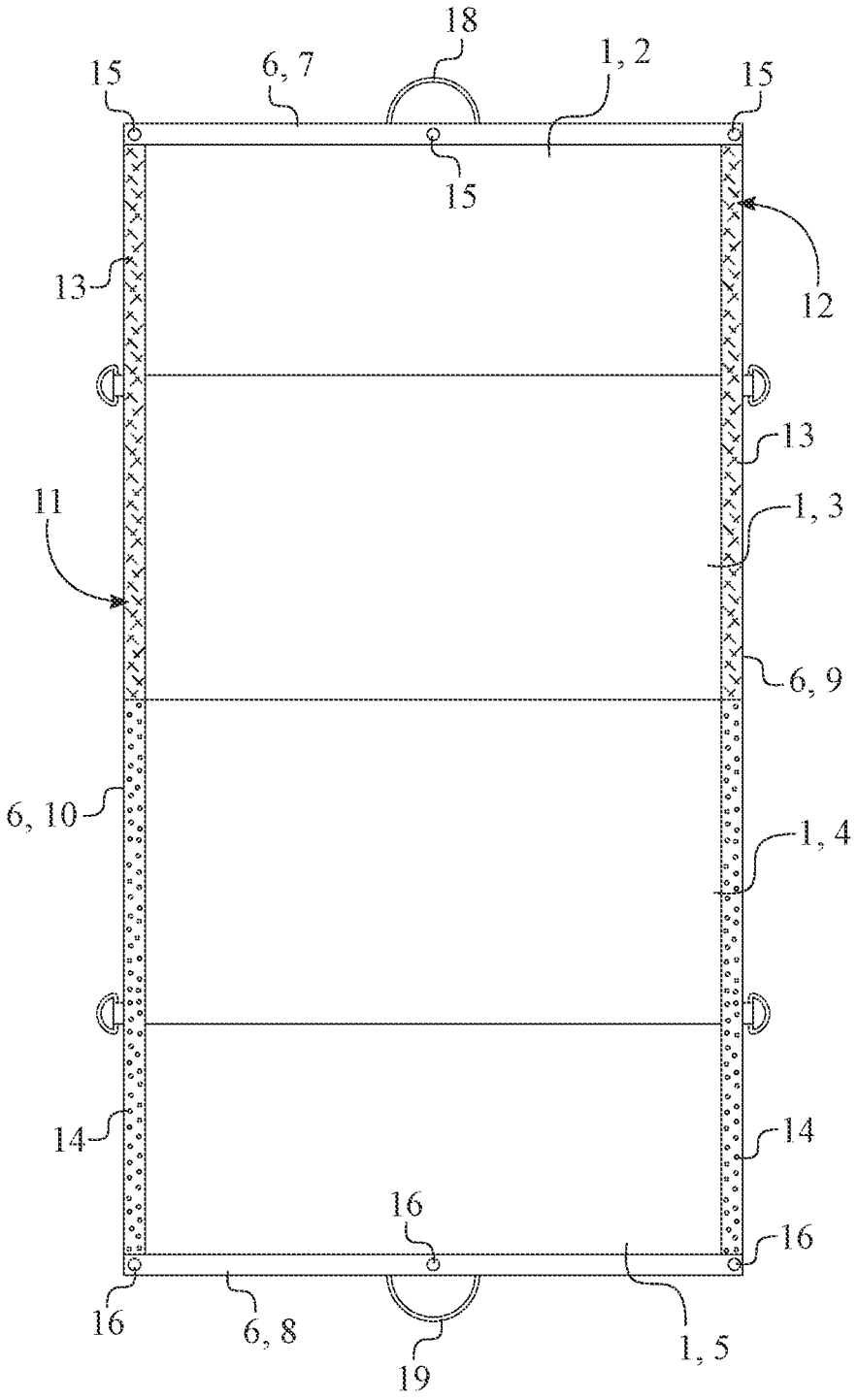
FIG. 2 is a front view of the present invention in the hammock configuration, showing the left fastener and the right fastener.

In reference to FIG. 1 and FIG. 2, the user preferably uses the buoyant head portion 2 to rest user's head thereupon. The user preferably uses the buoyant foot portion 5 to rest user's feet thereupon. The first middle portion 3 and the second middle portion 4 are preferably used to rest the user's body thereupon. When the present invention is utilized in the hammock configuration, the buoyant head portion 2 and the buoyant foot portion 5 float above the body of water thus allowing the present invention to float on the body of water as the user lies upon it. Furthermore, buoyant head portion 2 is able to elevate the user's head above the water line to provide a comfortable resting position. The first middle portion 3 and the second middle portion 4 support the weight of the user and is generally arched when the present invention is in use. This allows the user's body to at least be partially immersed in the water to reduce the amount of surface exposed to the direct sunlight and to cool down user's body. Preferably, the buoyant head portion 2 and the first middle portion 3 are connected to each other by overlapping and securing borders together by sewing or other industry standard securement mechanisms. The second middle portion 4 and the first middle portion 3 are connected to each other by overlapping and securing borders together by sewing or other industry standard securement mechanisms. The buoyant foot portion 5 and the second middle portion 4 are connected to each other by overlapping and securing borders together by sewing or other industry standard securement mechanisms.

Figure 3:
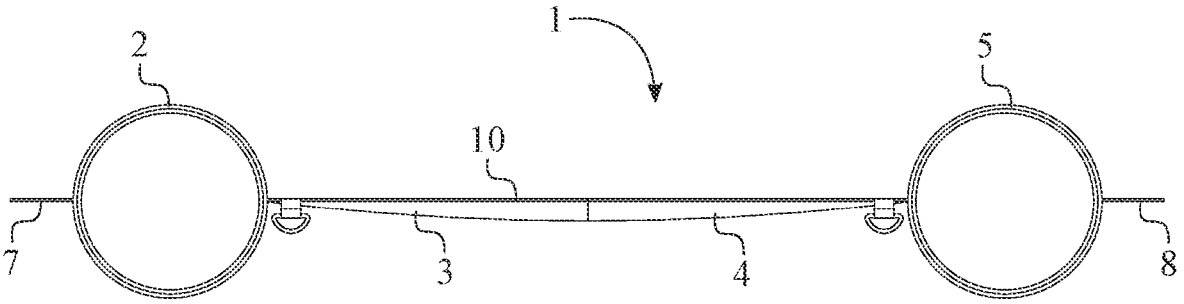
FIG. 3 is a right-side view of the present invention.
Figure 4:
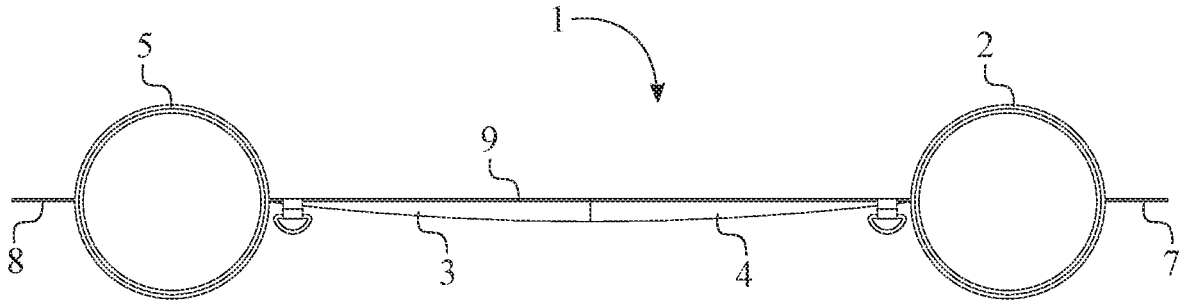
FIG. 4 is a left-side view of the present invention.

In reference to some embodiments of the present invention, as shown in FIG. 3 and FIG. 4, the buoyant head portion 2 can be an inflatable body, and the buoyant foot portion 5 can be an inflatable body. More specifically, the buoyant head portion 2 and the buoyant foot portion 5 both define generally rectangular outlines when uninflated. The buoyant head portion 2 may comprise a first chamber and a first air valve. The user can inflate the first chamber through the first air valve as the buoyant head portion 2 defines a cylindrical shape when inflated. The buoyant foot portion 5 may comprise a second chamber and a second air valve. The user can inflate the second chamber through the second air valve as the buoyant foot portion 5 defines a cylindrical shape when inflated. The first middle portion 3 and the second middle portion 4 are made of flexible fabric or material to adapt the natural curvature of the user's body. Furthermore, when the user desires to adjust the depth at which the user's head and foot position with respect to the water line, the user can inflate or deflate the first chamber and/or the second chamber to control the buoyancy of present invention.

In reference to FIG. 1 and FIG. 2, the outer edge 6 may further comprise a top edge 7 and a bottom edge 8 in addition to the left edge 9 and the right edge 10. The top edge 7 and the bottom edge 8 are oppositely positioned of each other about the main body 1 thus delineating the top-outer border and the bottom-outer border. The left edge 9 and the right edge 10 are oppositely positioned of each other about the main body 1 and preferably positioned perpendicular to the top edge 7 and the bottom edge 8. The left edge 9 is positioned in between the top edge 7 and the bottom edge 8 and delineates the left-outer border. The right edge 10 is positioned in between the top edge 7 and the bottom edge 8 and delineates the right-outer boarder. More specifically, the top edge 7 is terminally connected across the buoyant head portion 2 and forms the top-outer border. The bottom edge 8 is terminally connected across the buoyant foot portion 5 and forms the bottom-outer border. The left edge 9 is terminally connected along the buoyant head portion 2, the first middle portion 3, the second middle portion 4, and the buoyant foot portion 5 to form the left-outer border. The right edge 10 is terminally connected along the buoyant head portion 2, the first middle portion 3, the second middle portion 4, and the buoyant foot portion 5 to form the right-outer border.

In reference to FIG. 2, the left fastener 11 and the right fastener 12 may each comprise a first interlocking fastener 13 and a second interlocking fastener 14 so that the present invention can be configured into the bag configuration from the hammock configuration. The left fastener 11 and the right fastener 12 are positioned coplanar to each other. In other words, the left fastener 11 and the right fastener 12 are both positioned on one side of the main body 1. In reference to the left end of the main body 1, the first interlocking fastener 13 of the left fastener 11 is connected to the left edge 9 in such a way that the first interlocking fastener 13 of the left fastener 11 is positioned adjacent to the buoyant head portion 2 and the first middle portion 3. The second interlocking fastener 14 of the left fastener 11 is connected to the left edge 9 as the second interlocking fastener 14 of the left fastener 11 is positioned adjacent to the buoyant foot portion 5 and the second middle portion 4. In reference to the right end of the main body 1, the first interlocking fastener 13 of the right fastener 12 is connected to the right edge 10 in such a way that the first interlocking fastener 13 of the right fastener 12 is positioned adjacent to the buoyant head portion 2 and the first middle portion 3. The second interlocking fastener 14 of the right fastener 12 is connected to the right edge 10 as the second interlocking fastener 14 of the right fastener 12 is positioned adjacent to the buoyant foot portion 5 and the second middle portion 4.

Preferably, the present invention utilizes a hook-and-loop fastener as the left fastener 11 and the right fastener 12. More specifically, the first interlocking fastener 13 of the left fastener 11 and the right fastener 12 can be a hook section of the hook-and-loop fastener, and the second interlocking fastener 14 of the left fastener 11 and the right fastener 12 can be a loop section of the hook-and-loop fastener or vice versa. Even though the present invention uses the hook-and-loop fastener as the left fastener 11 and the right fastener 12, the present invention can be configured with zippers, magnetic fasteners, or any other type of industry standard fasteners without deviating from the scope of the functionality.

As shown in FIGS. 1-5, when the present invention is configured into the hammock configuration, the main body 1 is laid flat to maximize the total surface area that rests below the user's body. More specifically, the first middle portion 3 and the second middle portion 4 are positioned in between the buoyant head portion 2 and the buoyant foot portion 5 so that the present invention is able to float on the body of water. Resultantly, the first interlocking fastener 13 of the left fastener 11 is linearly positioned offset to the second interlocking fastener 14 of the left fastener 11. The first interlocking fastener 13 of the right fastener 12 is linearly positioned offset to the second interlocking fastener 14 of the right fastener 12. The user is then able to rest their head upon the buoyant head portion 2, their feet atop the buoyant foot portion 5, and their body atop the first middle portion 3 and the second middle portion 4.

Figure 5:
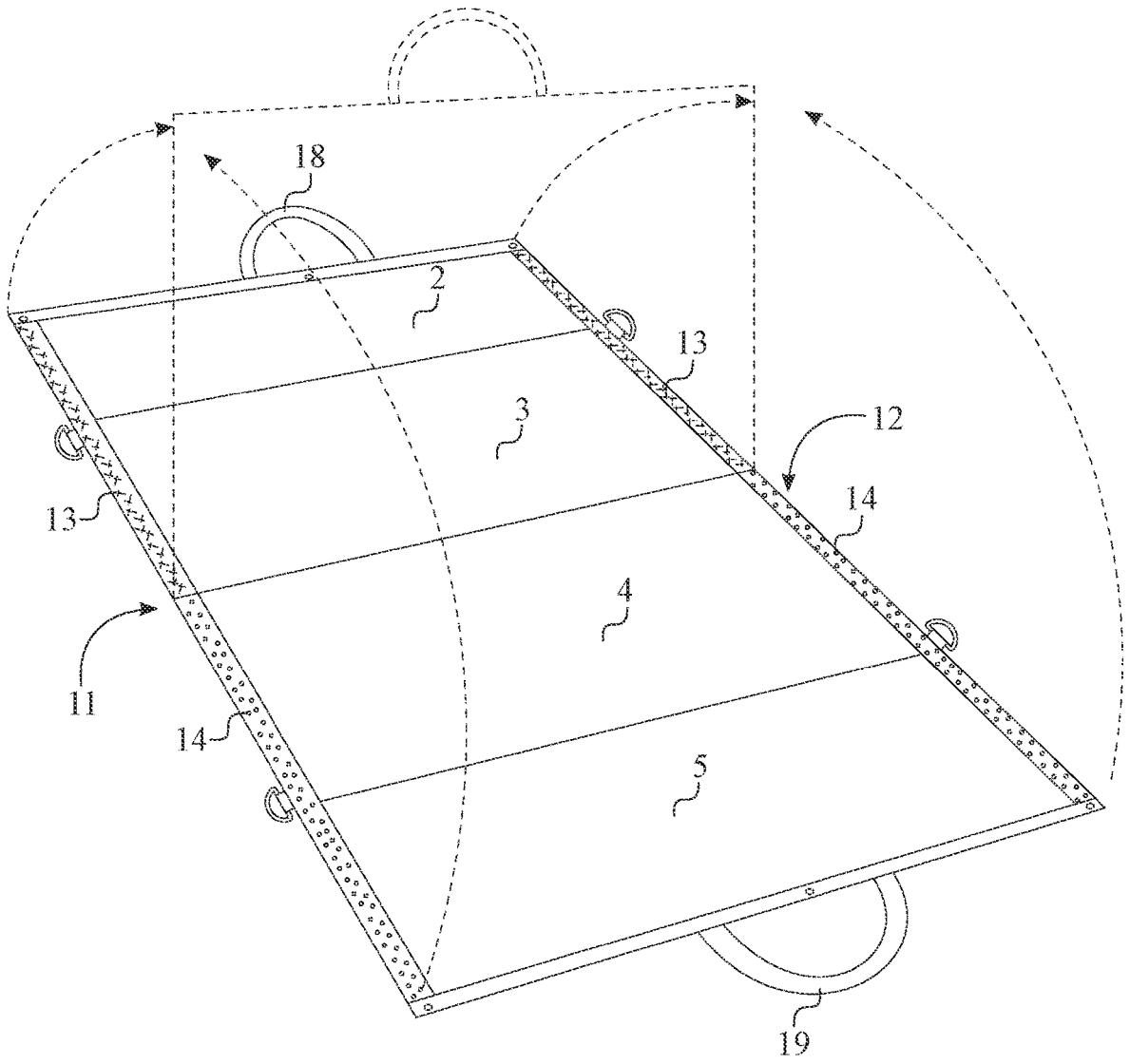
FIG. 5 is a top perspective view of the present invention, showing the hammock configuration changing into the bag configuration.
Figure 6:
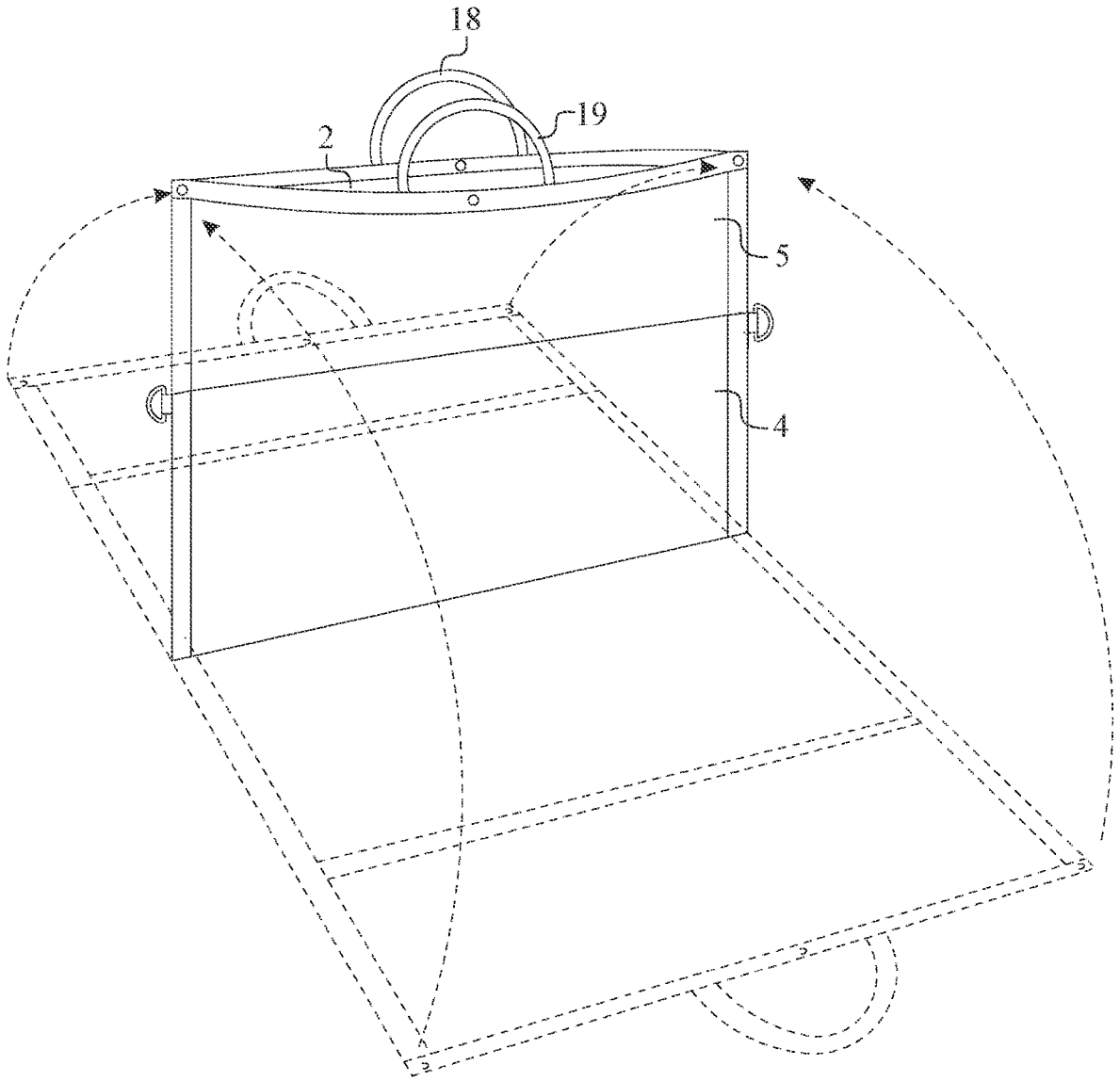
FIG. 6 is a top perspective view of the present invention, showing the bag configuration that has been changed from the hammock configuration.

As shown in FIG. 5 and FIG. 6, when the present invention is configured into the bag configuration, the main body 1 is folded in half to create the storage area. More specifically, the first middle portion 3 is positioned adjacent to the second middle portion 4 as the buoyant head portion 2 is positioned adjacent to the buoyant foot portion 5. Then, the first interlocking fastener 13 of the left fastener 11 is attached to the second interlocking fastener 14 of the left fastener 11 to create a left linear seal and to complete the left end of the bag configuration. Similarly, the first interlocking fastener 13 of the right fastener 12 is attached to the second interlocking fastener 14 of the right fastener 12 to create a right linear seal and to complete the right end of the bag configuration. As a result, the folded line between the first middle portion 3 and the second middle portion 4, the attachment of the first interlocking fastener 13 and the second interlocking fastener 14 of the left fastener 11, and the attachment of the first interlocking fastener 13 and the second interlocking fastener 14 of the right fastener 12 create the bag configuration. An opening for the bag configuration is provided in between the top edge 7 and the bottom edge 8 as the top edge 7 and the bottom edge 8 are positioned adjacent to each other. The user is then able to store essential items within the bag configuration as the internal storage space is accessed through the opening.

In reference to FIG. 2, the present invention may further comprise at least one first bag fastener 15 and at least one second bag fastener 16 so that the opening of the bag configuration can be closed. More specifically, the first bag fastener 15 is connected to the top edge 7 of the outer edge 6. The second bag fastener 16 is connected to the bottom edge 8 of the outer edge 6 as the first bag fastener 15 is positioned directly opposite of the second bag fastener 16. In order to close the opening of the bag configuration, the first bag fastener 15 is attached to the second bag fastener 16. The present invention preferably uses a stud fastener as the first bag fastener 15, and a socket fastener as the second bag fastener 16 so that the stud fastener is able to attach with the socket fastener to close the opening of the bag configuration.

In reference to FIG. 1, the present invention may further comprise a plurality of attachments 17 so other floating accessories can be attached to the present invention. More specifically, the plurality of attachments 17 is perimetrically connected around the outer edge 6 thus allowing multiple attachment mechanisms within the present invention. Preferably, the present invention utilizes a plurality of d-rings as the plurality of attachments 17. The plurality of d-rings is preferably secured to the left edge 9 and the right edge 10 and positioned adjacent to the first middle portion 3 and the second middle portion 4. Even though the present invention uses the plurality of d-rings as the plurality of attachments 17, the present invention can be configured with grommets, hooks, or any other type of industry standard attachments without deviating from the scope of the functionality.

In reference to FIG. 5 and FIG. 6, the present invention may further comprise a first handle 18 and a second handle 19. More specifically, the first handle 18 is centrally connected to the buoyant head portion 2 and outwardly oriented from the main body 1. The second handle 19 is centrally connected to the buoyant foot portion 5 and outwardly oriented from the main body 1. As a result, the first handle 18 and the second handle 19 can function as shoulders straps or carrying handles for the present invention. For example, when the present invention is configured into the bag configuration, the user can use the first handle 18 and the second handle 19 to carry the present invention as a traditional bag.

Although the invention has been explained in relation to its preferred embodiment, it is to be understood that many other possible modifications and variations can be made without departing from the spirit and scope of the invention as hereinafter claimed.

What is claimed is:

1. A floating hammock and carrying bag apparatus comprising:

a main body;

an outer edge;

a left fastener;

a right fastener;

the main body comprising a buoyant head portion, a first middle portion, a second middle portion, and a buoyant foot portion;

the left fastener and the right fastener each comprising a first interlocking fastener and a second interlocking fastener;

the buoyant head portion being adjacently connected to the first middle portion;

the second middle portion being adjacently and foldably connected to the first middle portion, opposite of the buoyant head portion;

the buoyant foot portion being adjacently connected to the second middle portion, opposite of the first middle portion;

the outer edge being perimetrically connected around the buoyant head portion, the first middle portion, the second middle portion, and the buoyant foot portion;

the left fastener being connected along a left edge of the outer edge;

the right fastener being connected along a right edge of the outer edge;

the left fastener and the right fastener being oppositely positioned of each other about the main body;

the main body being configured between a hammock configuration and a bag configuration through the left fastener and the right fastener;

the left fastener and the right fastener being positioned coplanar to each other;

the first interlocking fastener of the left fastener being connected to the left edge;

the first interlocking fastener of the left fastener being positioned adjacent to the buoyant head portion and the first middle portion;

the second interlocking fastener of the left fastener being connected to the left edge;

the second interlocking fastener of the left fastener being positioned adjacent to the buoyant foot portion and the second middle portion;

the first interlocking fastener of the right fastener being connected to the right edge;

the first interlocking fastener of the right fastener being positioned adjacent to the buoyant head portion and the first middle portion;

the second interlocking fastener of the right fastener being connected to the right edge; and the second interlocking fastener of the right fastener being positioned adjacent to the buoyant foot portion and the second middle portion.

2. The floating hammock and carrying bag apparatus as claimed in claim 1, wherein the buoyant head portion is an inflatable body.

3. The floating hammock and carrying bag apparatus as claimed in claim 1, wherein the buoyant foot portion is an inflatable body.

4. The floating hammock and carrying bag apparatus as claimed in claim 1, wherein the main body is formed into a rectangular body.

5. The floating hammock and carrying bag apparatus as claimed in claim 1 comprising:

the outer edge further comprising a top edge and a bottom edge;

the top edge and the bottom edge being oppositely positioned of each other about the main body;

the left edge being positioned in between the top edge and the bottom edge;

the right edge being positioned in between the top edge and the bottom edge;

the left edge and the right edge being oppositely positioned of each other about the main body;

the top edge being terminally connected across the buoyant head portion;

the bottom edge being terminally connected across the buoyant foot portion;

the left edge being terminally connected along the buoyant head portion, the first middle portion, the second middle portion, and the buoyant foot portion; and the right edge being terminally connected along the buoyant head portion, the first middle portion, the second middle portion, and the buoyant foot portion.

6. The floating hammock and carrying bag apparatus as claimed in claim 1 comprising:

wherein the main body, the left fastener, and the right fastener are arranged into the hammock configuration;

the first middle portion and the second middle portion being positioned in between the buoyant head portion and the buoyant foot portion;

the first interlocking fastener of the left fastener being linearly positioned to the second interlocking fastener of the left fastener; and the first interlocking fastener of the right fastener being linearly positioned to the second interlocking fastener of the right fastener.

7. The floating hammock and carrying bag apparatus as claimed in claim 1 comprising:

wherein the main body, the left fastener, and the right fastener are arranged into the bag configuration;

the first middle portion being positioned adjacent to the second middle portion;

the buoyant head portion being positioned adjacent to the buoyant foot portion;

the first interlocking fastener of the left fastener being attached to the second interlocking fastener of the left fastener; and the first interlocking fastener of the right fastener being attached to the second interlocking fastener of the right fastener.

8. The floating hammock and carrying bag apparatus as claimed in claim 7 comprising:

at least one first bag fastener;

at least one second bag fastener;

the first bag fastener being connected to a top edge of the outer edge;

the second bag fastener being connected to a bottom edge of the outer edge; and the first bag fastener being attached to the second bag fastener.

9. The floating hammock and carrying bag apparatus as claimed in claim 1 comprising:

a plurality of attachments; and the plurality of attachments being perimetrically connected around the outer edge.

10. The floating hammock and carrying bag apparatus as claimed in claim 1 comprising:

a first handle;

a second handle;

the first handle being centrally connected to a top edge of the outer edge; and the second handle being centrally connected to a bottom edge of the outer edge.

11. A floating hammock and carrying bag apparatus comprising:

a main body;

an outer edge;

a left fastener;

a right fastener;

a first handle;

a second handle;

the main body comprising a buoyant head portion, a first middle portion, a second middle portion, and a buoyant foot portion;

the left fastener and the right fastener each comprising a first interlocking fastener and a second interlocking fastener;

the buoyant head portion being adjacently connected to the first middle portion;

the second middle portion being adjacently and foldably connected to the first middle portion, opposite of the buoyant head portion;

the buoyant foot portion being adjacently connected to the second middle portion, opposite of the first middle portion;

the outer edge being perimetrically connected around the buoyant head portion, the first middle portion, the second middle portion, and the buoyant foot portion;

the left fastener being connected along a left edge of the outer edge;

the right fastener being connected along a right edge of the outer edge;

the left fastener and the right fastener being oppositely positioned of each other about the main body;

the main body being configured between a hammock configuration and a bag configuration through the left fastener and the right fastener;

the left fastener and the right fastener being positioned coplanar to each other;

the first interlocking fastener of the left fastener being connected to the left edge;

the first interlocking fastener of the left fastener being positioned adjacent to the buoyant head portion and the first middle portion;

the second interlocking fastener of the left fastener being connected to the left edge;

the second interlocking fastener of the left fastener being positioned adjacent to the buoyant foot portion and the second middle portion;

the first interlocking fastener of the right fastener being connected to the right edge;

the first interlocking fastener of the right fastener being positioned adjacent to the buoyant head portion and the first middle portion;

the second interlocking fastener of the right fastener being connected to the right edge;

the second interlocking fastener of the right fastener being positioned adjacent to the buoyant foot portion and the second middle portion;

the first handle being centrally connected to a top edge of the outer edge; and the second handle being centrally connected to a bottom edge of the outer edge.

12. The floating hammock and carrying bag apparatus as claimed in claim 11, wherein the buoyant head portion is an inflatable body, and wherein the buoyant foot portion is an inflatable body.

13. The floating hammock and carrying bag apparatus as claimed in claim 11, wherein the main body is formed into a rectangular body.

14. The floating hammock and carrying bag apparatus as claimed in claim 11 comprising:

the outer edge further comprising a top edge and a bottom edge;

the top edge and the bottom edge being oppositely positioned of each other about the main body;

the left edge being positioned in between the top edge and the bottom edge;

the right edge being positioned in between the top edge and the bottom edge;

the left edge and the right edge being oppositely positioned of each other about the main body;

the top edge being terminally connected across the buoyant head portion;

the bottom edge being terminally connected across the buoyant foot portion;

the left edge being terminally connected along the buoyant head portion, the first middle portion, the second middle portion, and the buoyant foot portion; and the right edge being terminally connected along the buoyant head portion, the first middle portion, the second middle portion, and the buoyant foot portion.

15. The floating hammock and carrying bag apparatus as claimed in claim 11 comprising:

wherein the main body, the left fastener, and the right fastener are arranged into the hammock configuration;

the first middle portion and the second middle portion being positioned in between the buoyant head portion and the buoyant foot portion;

the first interlocking fastener of the left fastener being linearly positioned to the second interlocking fastener of the left fastener; and the first interlocking fastener of the right fastener being linearly positioned to the second interlocking fastener of the right fastener.

16. The floating hammock and carrying bag apparatus as claimed in claim 11 comprising:

wherein the main body, the left fastener, and the right fastener are arranged into the bag configuration;

the first middle portion being positioned adjacent to the second middle portion;

the buoyant head portion being positioned adjacent to the buoyant foot portion;

the first interlocking fastener of the left fastener being attached to the second interlocking fastener of the left fastener; and the first interlocking fastener of the right fastener being attached to the second interlocking fastener of the right fastener.

17. The floating hammock and carrying bag apparatus as claimed in claim 16 comprising:

at least one first bag fastener;

at least one second bag fastener;

the first bag fastener being connected to a top edge of the outer edge;

the second bag fastener being connected to a bottom edge of the outer edge; and the first bag fastener being attached to the second bag fastener.

18. The floating hammock and carrying bag apparatus as claimed in claim 11 comprising:

a plurality of attachments; and the plurality of attachments being perimetrically connected around the outer edge.

* * * * *